United States Patent [19]

Resnick

[11] Patent Number: 4,878,412

[45] Date of Patent: Nov. 7, 1989

[54] ELECTROMAGNETIC PICKUP FOR A STRINGED MUSICAL INSTRUMENT HAVING FERROMAGNETIC STRINGS AND METHOD

[76] Inventor: Martin H. Resnick, Rte. 2, Guysville, Ohio 45735

[21] Appl. No.: 295,003

[22] Filed: Jan. 9, 1989

Related U.S. Application Data

[63] Continuation of Ser. No. 65,051, Jun. 22, 1987, abandoned.

[51] Int. Cl.[4] ..... G10H 3/18; H01F 21/00

[52] U.S. Cl. ..... 84/726; 336/83; 336/110

[58] Field of Search ..... 84/1.14–1.16; 336/83, 110

[56] References Cited

U.S. PATENT DOCUMENTS

| | | | |
|---|---|---|---|
| 3,571,483 | 3/1971 | Davidson | 84/1.16 |
| 3,588,311 | 6/1971 | Zoller | 84/1.15 |
| 3,902,394 | 9/1975 | Stich | 84/1.15 |
| 4,442,749 | 4/1984 | DiMarzio et al. | 84/1.15 |
| 4,624,172 | 11/1986 | McDougall | 84/1.15 |

*Primary Examiner*—Stanley J. Witkowski

[57] ABSTRACT

A pickup for an electrical instrument of the stringed type which comprises a pair of coil assemblies disposed within hollow magnetic bushings, the coils having its winding axis perpendicular to the strings, a hollow cylindrical shaped permanent magnet made of rubber-like plastic positioned around the outside circumference of each coil assembly, parallel to the winding axis of the coil. The direction of coil winding and magnet polarity around the first bobbin is opposite to that of the second bobbin. The magnets being disposed within the body of the pickup, said magnets serving as a sleeve for mounting coil assemblies and coil forms and suppresses microphonics by acting as a dampening means. A very dense and improved magnetic flux path passes from the inside surface of the hollow magnets through the coil assemblies disposed within said magnetic assemblies, said flux then sweeping the string area in a radial motion therein producing a novel tone having improved sustain qualities. The basic geometric shapes of the pickup components lend themselves well in regards to simplifying manufacturing procedure.

5 Claims, 3 Drawing Sheets

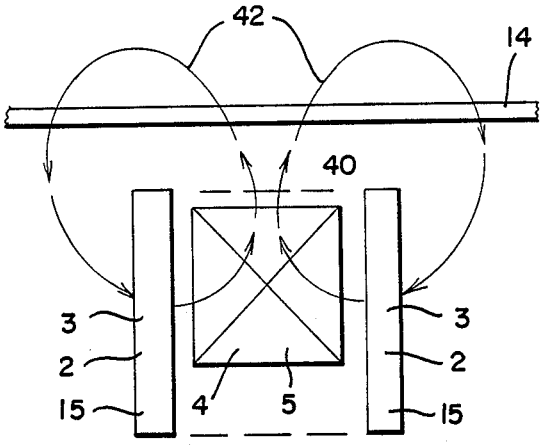
FIG. 7
FIG. 8
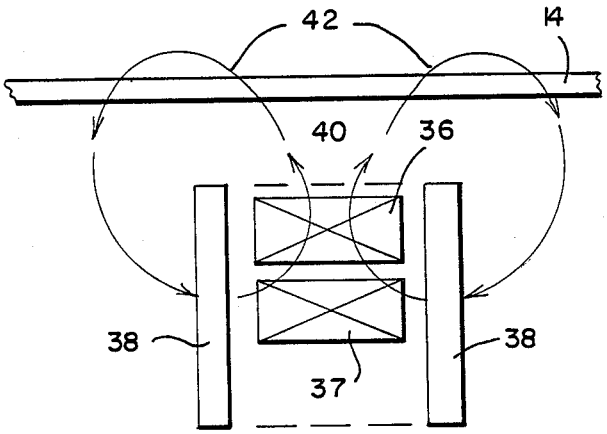
FIG. 9
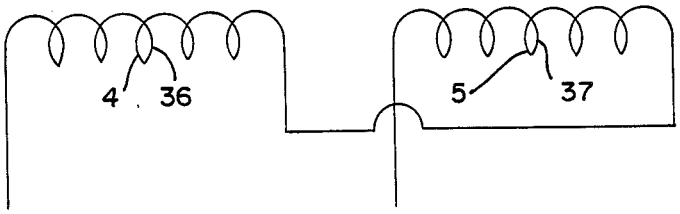

ELECTROMAGNETIC PICKUP FOR A STRINGED MUSICAL INSTRUMENT HAVING FERROMAGNETIC STRINGS AND METHOD

This application is a continuation of application Ser. No. 065,051, filed June 22, 1987, now abandoned.

BACKGROUND OF INVENTION

1. Field of the Invention

This invention relates to electrical pickups adapted for use with multistringed musical instruments having strings formed of ferromagnetic material to produce an output signal, the amplitude of frequency of which is representative of the vibrations of a ferromagnetic string. In the preferred embodiment, an electromagnetic pickup is adapted for use with a guitar or electric bass guitar.

2. Description of Prior Art

The use of electrical pickups for stringed musical instruments having ferromagnetic strings is well known in the art. The modern commerical trends seem to point to the hum cancelling type pickups that in the most common instances are in the single coil stacked position or the double coil side by side arrangement. U.S. Pat. No. 4,524,667 describes an example of the former, and U.S. Pat. No. 4,501,185 describes an example of the latter.

Most of modern commercial pickups have an oblong shaped coil form usually molded in plastic having hollow cavities through the said coil form wherein a magnetic iron cylinder, cylindrical magnet or threaded iron core with screw adjustment being fitted into each above said cavity.

U.S. Pat. Nos. 4,442,749, 4,026,178 and 4,133,243 feature one of the above core embodiments. Unfortunately sound vibrations in the air may be transmitted to the pickup and may set one or more internal parts of the pickup into resonant vibration to produce accompanying flux changes in output signals at the resonant frequency which, through positive feedback, sustain the resonant vibration and produce microphonic or squealing sounds from the speaker or speakers. The high material density of the conventional iron cores that fill the coil form cavities, relative high density of plastic coil forms in combination with the coils and the very close positions of said components to one another offer a disadvantage relating to suppressing microphonics. A feature in U.S. Pat. No. 3,962,946 deals with the above problem by separating each magnet from the major portion of its opening wall by a vibration dampening layer of silicon rubber or other resilient material. Resilient pads are also placed between the pickup housing and pickup parts enclosed thereby for the same purpose.

U.S. Pat. No. 3,962,946 discloses a pickup with a cup-shaped housing member having two side walls and a top wall made of brass and electrically connected to a base plate, forming an electric shield. U.S. Pat. No. 4,364,295 discloses a pickup shielding means by electrodepositing conducting metal onto a plastic form. The difficulty here is that dies or molds are very costly in regards to metal stamping and mold injection forms. This cost may not be a hardship to a large manufacturer, but maybe cost impractical to a small manufacturing entity.

Sound pickups of the humbucking type require very accurate positioning of the components, assembly and set up being tedious and costly, having delicate coil assemblies and sometime brittle magnets and are often subjected to rough handling.

SUMMARY OF THE PRESENT INVENTION

The invention relates to a new, novel and unique electrical pickup for a stringed musical instrument having ferromagnetic strings. In the first embodiment, the electrical pickup includes a pair of axially spaced coils, each of said coils mounted within a bushing, said bushing made of flexible rubber-like plastic. The above said magnetic bushings having a hollow cylindrical shape with thin walls are pressed and fixed into a hollow cavity in the pickup body, said block-like body made of non-magnetic material preferably wood. The coil is axially wound around a round bobbin-like form preferably made of wood or relative low density materials like wax impregnated paper or cardboard, although plastic will work as a latter preferred embodiment. The winding axis of coils and coil forms are perpendicular to the plane of strings on the musical instrument. The pickup housing is in the shape of a rectangular solid having two large surfaces, said surfaces having a top surface facing said strings and having a bottom surface positioned away from said strings. Electrical shielding means are fixed to the surface and within pickup body cavities, said means being a non magnetic electrical conducting sleeve or electrical conducting paint; having a non-magnetic electrical conducting plate attached to the top of the pickup body, a non- magnetic electrical conducting plate attached to the bottom of pickup, the said former and latter plates electrically connected to the shield within the pickup body cavity walls. Sound producing means being a pair of electrically insulated conducting coils electrically connected in series in an out of phase relationship. The magnetic polarities of the inner surfaces of said magnets are reversed to one another. Each coil assembly may work with a plurality of strings and arranged as to increase the effectiveness of the pickup. All inside adjoining surfaces of said pickup are tight fitting and fixed with a super glue type of penetrating adhesive that upon complete assembly results in a near solid block-like mass.

In the second embodiment of the pickup of the present invention the above pair of hollow magnetic cylinders are replaced by one flexible rubber-like plastic magnet, formed by looping a straight magnetic strip into a figure eight configuration; each cavity within the hollow loop of the figure eight configuration shape magnet accepts a coil assembly. The entire surface face of the inside of the first magnetic loop having a polarity opposite to the entire inside surface of the second loop.

In the third embodiment of the present invention a stacked co-axial arrangement may be employed having one pair of conducting coils, said coils wound axially in opposite directions, a winding axis perpendicular to the plane of the strings, said coils wound on an oblong shaped coil form, first coil winding electrically insulated from second coil winding by a thin paper-like spacer, said coils electrically connected in a series out of phase relationship. Magnetic means being a permanent flexible magnet formed in the shape of a hollow oblong bushing, the inside face of the said hollow magnet having a N polarity at the top and S polarity at the bottom, the outside face of said magnet having a N polarity at the top and a S polarity at the bottom.

It is a primary objective of the present invention to provide a new and improved sound pickup for a stringed musical instrument having low material cost, fast and easier assembling, all components lending themselves to be formed and fabricated utilizing a basic inexpensive production and tooling setup.

Yet another object of the present invention is to provide a new and improved sound pickup which can withstand rough handling and take physical abuse.

Yet another object of the present invention is to provide a new and improved sound pickup that produces a high quality tone of an improved and novel nature.

Yet another object of the present invention is to provide a new and improved sound pickup having an improved shielding means.

Yet another objective of the present invention is to provide a new and improved pickup having a low magnetic draw on the strings and improve string sustain.

Yet other advantages of the present invention are that the simple geometrical configurations of the pickup components lend themselves well to simplifying the alignment of machine tool operations assembly and jig set-ups.

Yet another advantage of the present invention is that sound producing means is accomplished very economically and simply by sandwiching the pickup body between two flat non magnetic electrical conducting plates, brushing the inside surface of the pickup body cavity or cavities with electrical conducting paint and electrically connecting them; thus eliminating the need for a dish shaped stamped metal or electroformed shielding cover; the initial expense of making dies for such cover being very costly and cost inefficient for a small production run.

Another advantage of the present invention is that the magnet, coil and bobbin assemblies are positioned in a tight fitting relationship in regards to their locations and are pressed into the pickup body, glued with a penetrating type of super glue, sandwiched between a flat metal cover plate on top and a flat metal base plate on the bottom of said pickup body; said cover and base plates fixed to pickup body with non-ferrous screws.

Yet another advantage of the present invention is that the permanent magnet or magnets can be made of a rubber-like plastic flexible material which has a low cost.

Yet another advantage of the present invention is that a rubber-like plastic magnet can easily be shaped into a bushing or looped into a figure eight configuration having two hollow cavities;the rubber-like walls of the above mentioned magnets suppressing microphonics by internally dampening the coil windings and coil forms from vibrations travelling through the air and through the pickup body.

Another advantage of the present invention is that there is no need for an iron or a magnetic core member to be positioned or fitted through and along the central axis of the coil form being an improvement in regards to suppressing microphonic squeal in the central axis section of the coil windings.

Yet another advantage of the present invention is that because a hollow opening to fit a core assembly is not needed in the axis position in the coil forms, the improvement being more space available on a coil form to accept more turns of coil winding wire or accommodate heavier gauge coil wire if so desired.

Yet another advantage of the present invention is the improvement regarding directing a strong fixed field of magnetic flux through the coil means in combination with a weak path of magnetic flux in the string area thereby producing an improved tone of novel quality; magnetic flux passes almost directly into coil means through a very small distance between the inner surface of a hollow magnet and the outside surface of the coil which results in a very dense magnetic field passing through the coil assemblies and a weaker flux field passing through the strings thereon lessening the magnetic pull on the strings which will improve sustain. High ratio of coil surface and magnet surface contact increase signal gain to help compromise for the weaker flux path above the pickup in the string region.

BRIEF DESCRIPTION OF THE DRAWING

FIG. 7 and 8 each present a crossectional view showing lines of magnetic force being directed from a permanent magnet means into one of the strings of the musical instrument and relates to various embodiments of the invention.

FIG. 9 is a wiring diagram of a pair of coils relating to various embodiments of the invention.

DETAILED DESCRIPTION OF THE PREFERRED EMBODIMENTS

Figure 1:
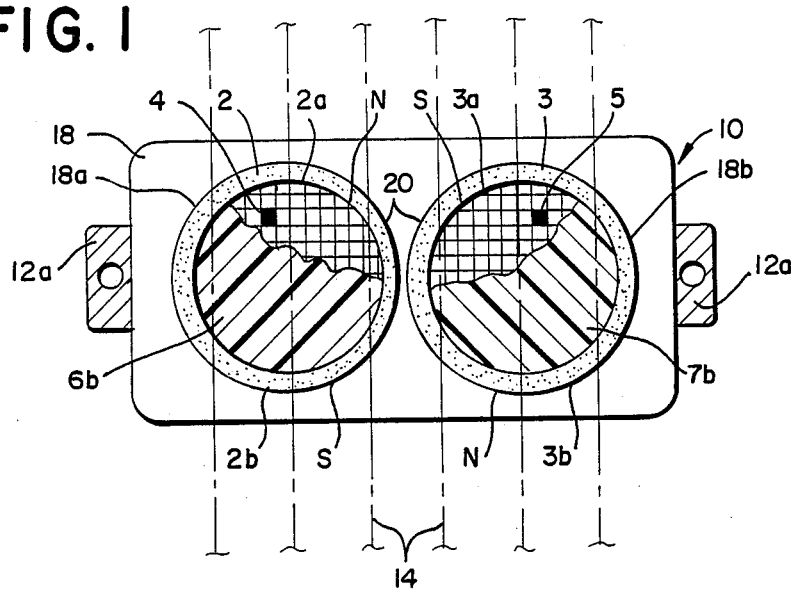
FIG. 1 is a top plan view with upper shield cover removed representing one embodiment of the electromagnetic pickup of the present invention.
Figure 2:
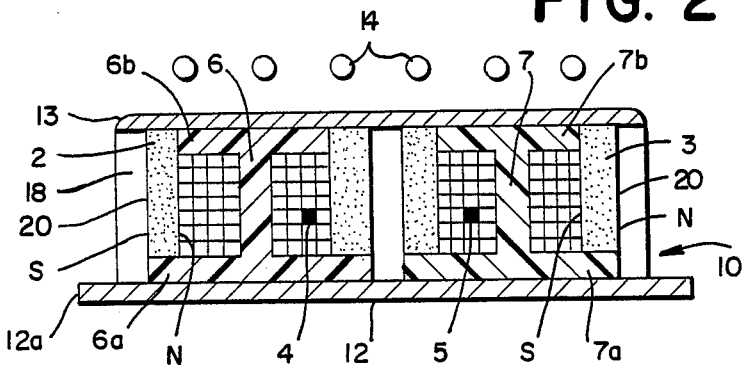
FIG. 2 is a sectional view of the embodiment of FIG. 1.

Referring now to FIGS. 1, 2, is a version of the magnetic pickup 10 as referred to in the first embodiment in the SUMMARY OF THE PRESENT INVENTION. The transducer 10 includes a base plate 12 of brass or similar rigid, non-magnetic material, suitable for mounting purposes. The base plate 12 includes a mounting foot plate **12*a* at each of its two ends, used to mount the pickup onto a stringed musical instrument (not shown) such as a guitar, mandolin, or bass guitar. The strings of said guitar instrument are shown schematically in FIG. 1 by the dashed lines designated 14. A pickup body 18, made of non-metallic material preferably wood or plastic is positioned longitudinally below strings 14. The pickup body 18 has two hollow cavities 18*a* and 18*b*; non-metallic electrical conducting paint 20 is fixed to the inside surface of the cavity walls 18*a* and 18*b*. A pair of hollow cylindrical permanent magnets 2 and 3 made of flexible rubber-like plastic material are shaped into a hollow bushing. The entire inside surface 2*a* of magnet 2 is polarized having a N polarity and the entire outside surface 2*b* of magnet 2 is polarized having a S polarity. The entire inside surface 3*a* of magnet 3 is polarized having a S polarity and the entire outside surface 3*b* of said magnet is polarized having a N polarity. Magnet 2 is fitted within cavity 18*a*, magnet 3 is fitted within cavity 18*b*, magnet 2 and 3 having their inside axis perpendicular to the surface of strings 14. The top surface of magnets 2 and 3 fitting flush with top of pickup body 18, and the lower surface of magnets 2 and 3 disposed a bit shallow within cavities 18*a* and 18*b*. FIG. 2 shows a pair of identical shaped coil forms 6, 7** wherein the top surface 6*b* of coil form 6 being circular, and the base 6*a* of coil form 6 radially extending outward forming a flange 6*a*, the top surface 7*b* of coil form 7 being circular, and the base 7*a* of coil form 7 radially extending outward forming a flange 7*a*. The top 6*b*, 7*b* of coil forms 6, 7, may be removed (not shown) after insertion within magnet means 2, 3; wax poured filling space previously occupied by tops of coil forms 6*b* and 7*b*. The preferred material of coil form 6, 7 being wood although plastic may be used. A coil means 4 is positioned on the inside of magnet means 2, a coil means 5 is positioned on the inside of magnet means 3; coil means 4 is axially wound on coil form 6, coil means 5 axially wound on coil form 7. The winding direction of coil means 4 being in opposite direction to coil means 5, winding axis of said coils 4, 5, being perpendicular to surface of strings 14. Coil means 4, 5, (FIG. 9) being electrically connected in series out of phase relationship. Completed coil form assembly 4, 6 being disposed into cavity 18*a*, completed coil form assembly 5, 7 being disposed into cavity 18*b*, coil form flange bases 6*a*, 7*a* resting flush with the bottom of pickup body 18. Magnetic means 2, 3 (FIG. 7), forms a very dense path of flux 42 (FIG. 7), through the coil assemblies 4, 5. The flux lines 42 pass from the inside surfaces 2*a*, 3*a* of magnetic means 2, 3 through coil means 4, 5 through an air gap 40 (FIG. 7) (not shown) into strings 14. The flux lines 42 flow around and along the string 14 in a radial path back through a second air gap (not shown) towards the outer edge surfaces 2*b*, 3*b* of magnets 2, 3 forming a magnetic circuit that sweeps each string at different angles and at varying mode positions resulting in an improvement in overcoming flat harmonic response in the generated tone when playing two or more strings. Magnetic means 2, 3 being of soft rubber-like plastic, effectively dampens physical vibrations traveling through the air and through the pickup body 18, the improvement here suppressing microphonics. The pickup body 18, magnetic means 2, 3, coil means 4, 5, and coil forms 6, 7, are dimensionally formed to a tolerance wherein they can be made to fit snugly and hold their proper position without shifting before final gluing within the pickup body 18; wherein the assembly comprising 2, 3, 4, 5, 6, 7, 18 is dipped in a solution of a thin penetrating type of super-glue adhesive to permanently fix all parts. A cover plate 13 made of brass or similar rigid non-magnetic material being fixed to the top of pickup body 18. Cover plate 13 and base plate 12 are electrically connected (not shown) to the surface of electrical conducting paint 20, forming shielding means. Base plate 12 is fixed to the bottom of pickup body 18, fixing means for base plate 12 and cover 13 being brass screws. The resulting pickup assembly 10 resembles a near solid rectangular block-like mass that can withstand physical abuse and is durable; the simple geometric shape of components offer an improvement in regards to manufacturing, and simplifying tooling set-up and assembly.

Figure 3:
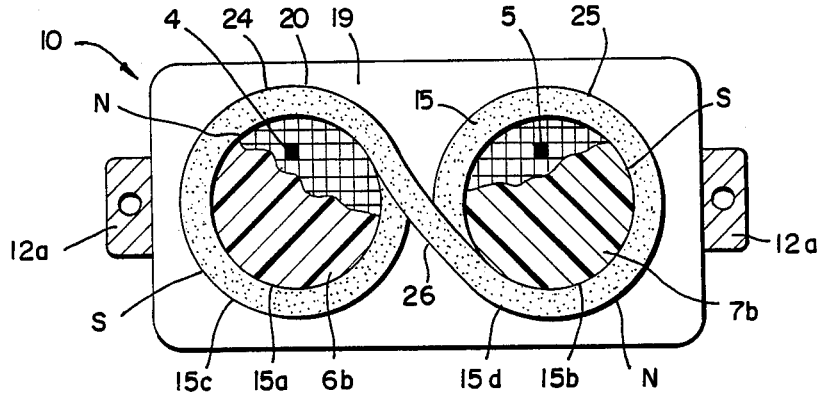
FIG. 3 is a top plan view with shielding cover removed of another embodiment of the electromagnetic pickup of the present invention.
Figure 4:
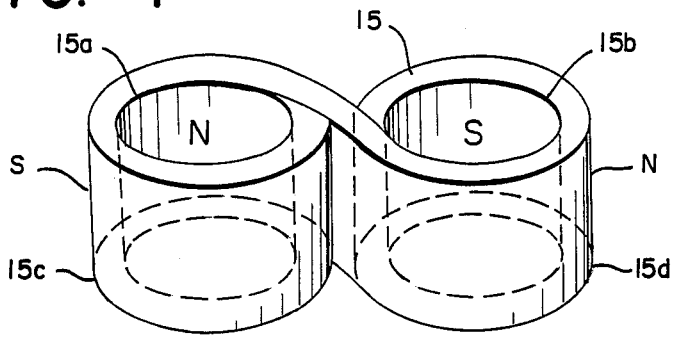
FIG. 4 is a view of the magnet assembly of the embodiment of FIG. 3.

FIG. 3, 4 refers to a second embodiment of the pickup as mentioned above in the SUMMARY OF THE PRESENT INVENTION. A permanent magnet 15 made of rubber-like flexible plastic is looped into a figure eight forming two closed circular cavities 15*a* and 15*b*. Magnet 15 is formed from one straight piece of flexible magnetic strip (not shown); first large surface of said magnetic strip (not shown) having a first polarity and second surface of said magnetic strip having a second polarity. The polarity of entire surface 15*a* inside the first loop of magnet 15 being N and the polarity on entire outside surface of said loop 15*c* being S, the polarity of entire surface 15*b* inside the second loop of magnet 15 being S and the polarity of entire surface 15*d* outside second loop being N. Pickup body 19 formed with two hollow cavities 24, 25 and a hollow slot 26; magnet 15 is fitted flush within cavities 24, 25, 26. Coil 4 (FIG. 2), coil form 6 (FIG. 2), are disposed within magnet hollow 15*a*; coil 5 FIG. 2), coil form 7 (FIG. 2) are disposed within magnet hollow 15*b*. Electrical conducting paint 20 being fixed to pickup cavity walls 24, 25, 26 and electrically connected to base plate 12 (FIG. 2) and cover plate 13 (FIG. 2). Assembly and fixing details similar to that of the pickup of the first embodiment mentioned above. The advantages of this embodiment being that one magnet in a humbucking circuit provides magnetic means, improves method for suppressing microphonics, and provides mounting means for a pair of coil and bobbin assemblies.

Figure 5:
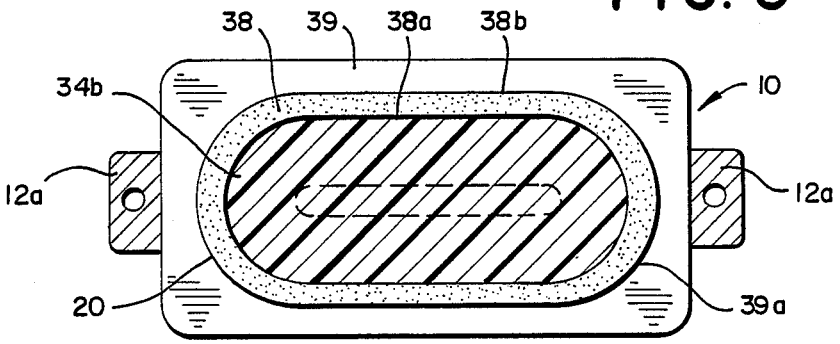
FIG. 5 is yet another top plan view with shielding cover removed of the electromagnetic pickup of the present invention.
Figure 6:
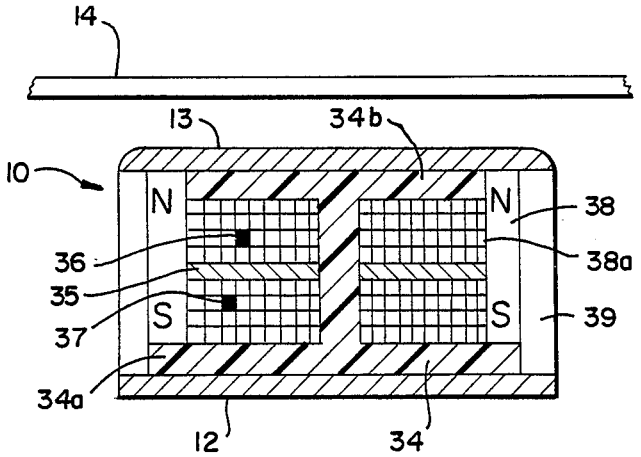
FIG. 6 is a sectional view of the embodiment of FIG. 5.

FIG. 5, 6 refers the third embodiment of the pickup as was disclosed in the SUMMARY OF THE PRESENT INVENTION. The transducer 10 has one oblong shaped coil form 34; coil form 34 having a radially extended flange 34*a* at its base, the winding axis of coil form 34 being perpendicular to strings 14. An electrical non-conducting spacer 35 is placed at the center of the coil form 34 dividing the inside area of coil form 34 into an upper cavity containing conducting coil 36 and a lower cavity containing conducting coil 37. Coils 36, 37 are axially wound being perpendicular to the surface of strings 14. The direction of the winding in coil 36 is opposite to that in coil 37; coils 36, 37 being electrically connected in series out of phase relationship. An oblong shaped permanent flexible rubber-like plastic magnet 38 closely surrounds coil assembly 36, 37. Magnet 38 has a N polarization on both surfaces of its upper half and a S polarization on both surfaces of its lower half. Magnet 38 is attached within a hollow cavity 39*a* of pickup body 39. A layer of non-magnetic electrical conducting paint 20 being fixed to the inside of an oblong shaped cavity 39*a*. Pickup body 39 being preferably made of wood but plastic may be used. Top surface 34*b* of coil form 34 and top surface of oblong shaped magnet 38 fit flush with top surface of pickup body 39. Top surface 34*b* of coil form 34 may be removed after insertion into magnet means 38, wax poured into space previously occupied by upper coil flange 34*b*. Lower edge of magnet 38 extends down along pickup cavity wall 39*a* until it stops a small distance short of the lower side of pickup body 39. Flanged base 34*a* of coil form 34 seats into space left short by the lower end of magnet 38. Bottom surface of flanged base 34*a* being flush with the bottom of pickup body 39. A base plate 12 of brass or similar rigid, non-magnetic material, suitable for mounting purposes includes a mounting foot plate 12*a* at each of its two ends used to attach said pickup onto the stringed instrument (not shown), a cover plate 13 made of brass or similar rigid, non-magnetic material are electrically connected to the electrical conducting paint 20 inside pickup body cavity wall 39*a* forming shielding means. Base plate 12 and cover plate 13 fixed to pickup body 39 with non-ferrous screws. A dense flux path 42 (FIG. 8) passes from the inside surface 38*a* of magnet 38 through coils 36, 37 continuing through the air 40 (FIG. 8) above pickup body 39 sweeping strings 14 in a radial path returning through the air space 40 below strings 14 to outside surface 38*b* of magnet 38 completing the magnetic circuit. Assembly and fixing details similar to method disclosed above relating to the electromagnetic pickup of the first embodiment.

What is claimed is:

1. An electromagnetic pickup, adapted for use with a stringed musical instrument in which the strings are formed of ferromagnetic material, comprising a nonconductive, non-magnetic body having at least one hollow cavity, at least one conducting coil wound on an electrically nonconductive, non-magnetic core form, a flexible permanently magnetic bushing adjacent to and surrounding said coil, said coil and magnetic bushing being arranged within said body so that in use they will be disposed perpendicular to the surface of a plurality of the strings of said instrument, whereby said magnetic bushing provides permanent magnet means to direct a magnetic field into said coil and at least one of said strings.

2. The pickup of claim 1 in which said body has two spaced apart hollow cavities in each of which is disposed one said coil wound on one said core form surrounded by one said bushing, and each of said coils are electrically connected in operational relationship to each other, whereby each said magnetic bushing provides permanent magnet means to direct a magnetic field into the coil it surrounds and at least one of said strings.

3. The pickup of claim 1 in which said body has one said cavity in which one said bushing is looped into a figure eight shape so as to form two circular spaces and one said coil wound on one said core form is disposed within each of said spaces, the said coils being electrically connected in operational relationship, whereby said bushing provides permanent magnet means to direct a magnetic field into each of said coils conjunctively with at least one of said strings.

4. The pickup of claim 1 in which said body contains one said cavity, in which one said bushing is disposed around its periphery, surrounding two said coils which are wound on one said core form in a manner such that they are physically spaced apart from one another by a layer of nonconductive material which surrounds said core, said coils being electrically connected in operational relationship, whereby said bushing provides permanent magnet means for directing a magnetic field into said coils and at least one of said strings.

5. The pickup of claim 1 in which an even number of said coils is present, arranged in pairs so each pair is electrically connected in series out of phase with one another and operationally connected in a humbucking relationship.

* * * * *